US011084627B2

(12) United States Patent
Stankowski et al.

(10) Patent No.: US 11,084,627 B2
(45) Date of Patent: Aug. 10, 2021

(54) BAG WELD WITH GUSSET

(71) Applicant: CYTIVA SWEDEN AB, Uppsala (SE)

(72) Inventors: Ralph Stankowski, Westborough, MA (US); Michael Miller, Westborough, MA (US)

(73) Assignee: CYTIVA SWEDEN AB, Uppsala (SE)

( * ) Notice: Subject to any disclaimer, the term of this patent is extended or adjusted under 35 U.S.C. 154(b) by 0 days.

(21) Appl. No.: 15/313,467

(22) PCT Filed: Jun. 10, 2015

(86) PCT No.: PCT/EP2015/062878
§ 371 (c)(1),
(2) Date: Nov. 22, 2016

(87) PCT Pub. No.: WO2015/197358
PCT Pub. Date: Dec. 30, 2015

(65) Prior Publication Data

US 2017/0183127 A1 Jun. 29, 2017

Related U.S. Application Data

(60) Provisional application No. 62/017,605, filed on Jun. 26, 2014.

(51) Int. Cl.

| | |
|---|---|
| ***B65D 30/20*** | (2006.01) |
| ***B65D 33/02*** | (2006.01) |
| *B65D 33/16* | (2006.01) |
| *B65D 75/00* | (2006.01) |

(52) U.S. Cl.
CPC ..... *B65D 31/10* (2013.01); *B65D 33/02* (2013.01); *B65D 33/16* (2013.01); *B65D 75/008* (2013.01)

(58) Field of Classification Search
CPC ..... B65D 31/10; B65D 33/02; B65D 33/16; B65D 75/008

(Continued)

(56) References Cited

U.S. PATENT DOCUMENTS 3,739,977 A * 6/1973 Shapiro ..... B65D 31/00 383/104
5,788,121 A * 8/1998 Sasaki ..... B65D 77/065 222/105

(Continued)

FOREIGN PATENT DOCUMENTS

CN 1130144 A 9/1996
CN 1416402 A 5/2003

(Continued)

OTHER PUBLICATIONS

JP2001253474Translation (Year: 2001).*

(Continued)

*Primary Examiner* — Jes F Pascua
*Assistant Examiner* — Nina K Attel
(74) *Attorney, Agent, or Firm* — Grogan, Tuccillo & Vanderleeden, LLP

(57) ABSTRACT

The invention discloses a plastic bag comprising:

at least one longitudinal end weld, wherein the end weld comprises an elongate transversely-oriented weld bounded by a first pair and a second pair of coterminous oblique welds extending along an oblique angle from the first and second ends of transversely-oriented weld, respectively, such that each pair of oblique welds forms a first and second apex, respectively, adjacent its respective end of the transversely-oriented weld, a first and second planar gusset attached to the bag along or within the first and second pair of oblique welds so as to overlie the first and second apex, respectively.

10 Claims, 19 Drawing Sheets

(58) Field of Classification Search
USPC ..... 383/120, 119
See application file for complete search history.

(56) References Cited

U.S. PATENT DOCUMENTS

| | | | | | |
|---|---|---|---|---|---|
| 5,988,422 | A * | 11/1999 | Vallot | A61J 1/05 | 220/495.06 |
| 2001/0008566 | A1 * | 7/2001 | Tetenborg | B65D 33/14 | 383/7 |
| 2003/0024950 | A1 | 2/2003 | Yoneyama et al. | | |
| 2010/0014790 | A1 * | 1/2010 | Colla | B65D 31/10 | 383/120 |

FOREIGN PATENT DOCUMENTS

| | | | | |
|---|---|---|---|---|
| DE | 202011109209 | U1 | | 7/2012 |
| FR | 653125 | A | | 3/1929 |
| JP | S5395323 | U | | 8/1978 |
| JP | 2001253474 | A | * | 9/2001 |
| JP | 2003312684 | A | | 11/2003 |
| JP | 2005104572 | A | | 4/2005 |
| JP | 5395323 | U | | 1/2014 |
| WO | 2013087216 | A1 | | 6/2013 |

OTHER PUBLICATIONS

International Search Report and Written Opinion regarding International Application No. PCT/EP2015/062878, dated Nov. 26, 2015, 12 pages.

* cited by examiner a)

b)

BAG WELD WITH GUSSET

CROSS-REFERENCE TO RELATED APPLICATIONS

This application is a filing under 35 U.S.C. 371 of international application number PCT/EP2015/062878, filed Jun. 10, 2015, which claims priority to U.S. application No. 62/017,605, filed Jun. 26, 2014, the entire disclosures of each of which are hereby incorporated by reference.

FIELD OF THE INVENTION

The present invention relates to polymeric bags having components that may be welded together so as to form sealed seams in the bag. More particularly, the present invention relates to a polymeric bag having a gusset positioned between overlying edges of the bag about a position of stress concentration formed when the bag is expanded or internally pressurized.

BACKGROUND OF THE INVENTION

The art includes polymeric bags formed from polymeric sheets which are welded together along elongate edges so as to define an enclosed chamber within the bag. Such bags are useful as disposable bioreactors, disposable mixing chambers, or storage containers. The bags may have various fittings attached to one or more walls of the bag to allow access to the interior chamber of the bag while maintaining the environmental integrity of the chamber. The bags may be shipped in a collapsed, essentially flat, shape while then being able to expand as contents are added to the bag.

Referring to FIGS. 1-3, a prior art bag 1 may contain a pair of tri-seam welds 2 at each end thereof. The tri-seam weld design allows the bag to inflate to have rounded ends, if not a rounded shape, when unconstrained by a rigid holding vessel. These tri-seam welds each form an apex 5. When the bag 1 is internally pressurized, the art has seen material failure of bag 1 at one or both of the apexes 5 at one end when inflated close to the design level of 4.8 kPa (0.7 psi). When bag 1 is formed from multiple-layer sheets, it is possible that only one of the layers at an apex 5 fails so as to form a tear or hole 6 at the apex 5. In many applications, such a material failure means failure of the bag for its intended purpose.

DETAILED DESCRIPTION OF PREFERRED EMBODIMENTS

Figure 1:
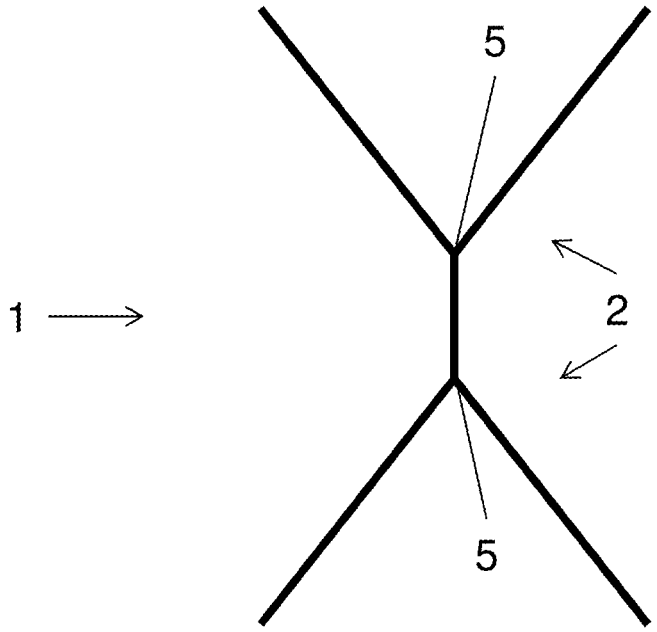
FIG. 1 depicts a bag end with two tri-seam welds of the prior art.
Figure 2:
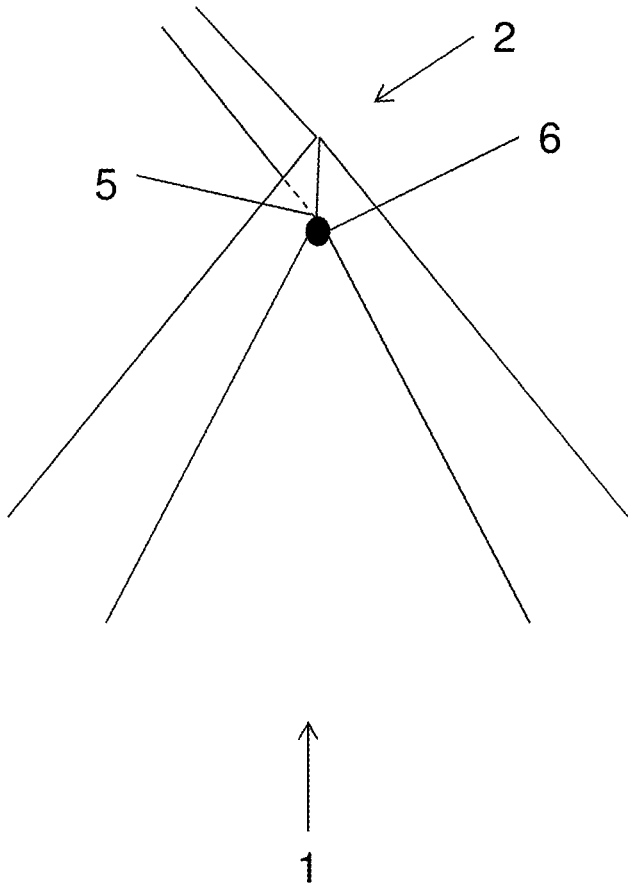
FIG. 2 depicts a tri-seam weld of the prior art which has failed under the internal pressure within the bag.
Figure 3:
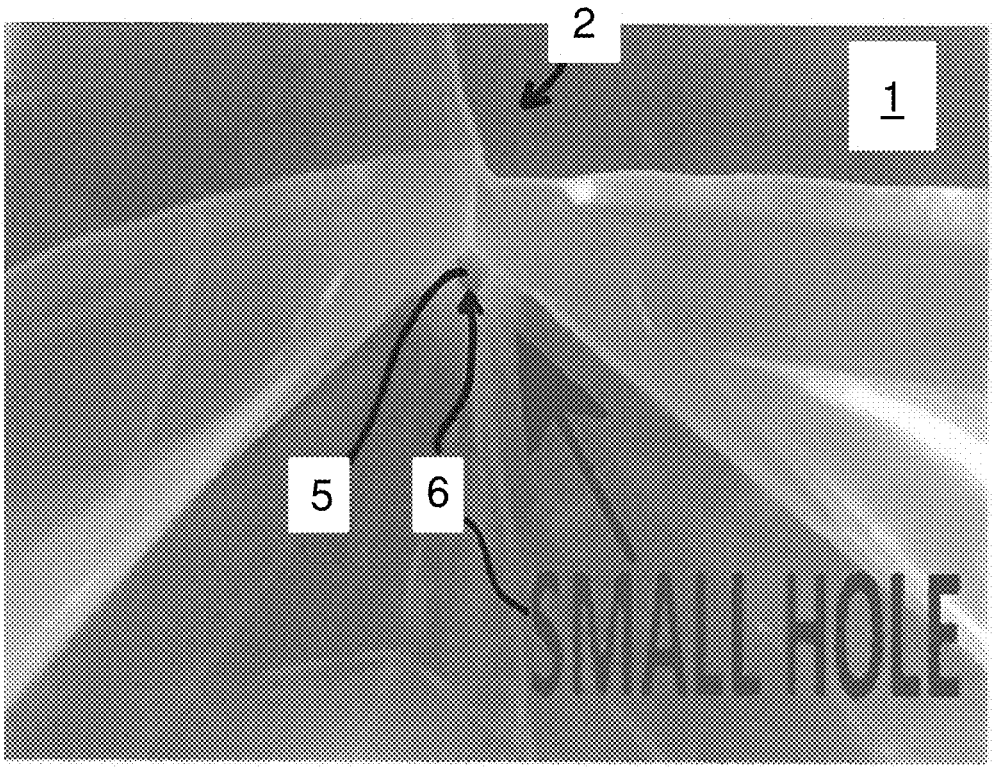
FIG. 3 depicts another failure of a tri-seam weld of the prior art. a) photograph, b) drawing outline of photograph.
Figure 3:
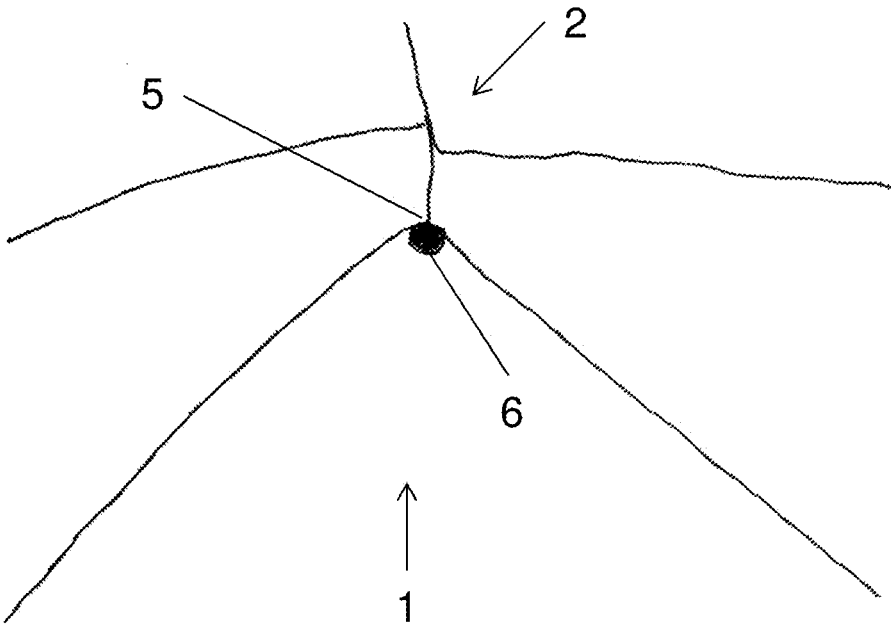

In certain preferred embodiments, the present invention provides a gusset which is joined to an elongate plastic bag at a seam formed to close the bag. The gusset is provided adjacent to a region of stress concentration resulting from an internal pressure within the bag. The region of stress concentration is a result of at least two seams meeting at an angle at a region where the bag is otherwise unconstrained by an outer rigid container. The two oblique seams meet so as to be coterminous at one end of a third seam, and the two oblique seams will form an apex at the region of stress concentration. The apex will desirably have the gusset sealed to the bag along the two seams forming the apex and the gusset will include a depending portion which is thus positioned adjacent to the apex so as to cover (ie, span or overlay) the apex. Where a bag seam forms more than one apex, the present invention desirably provides a gusset adjacent each apex formed. The gusset is formed having opposed major surfaces formed from a weldable material, such as polyethylene to enable the edge of the gusset welded to the oblique welds to also be welded thereto.

Should the bag be employed where one end seam is positioned within and against a rigid container or vessel while the other end seam is exposed and unconstrained by a container, the present invention contemplates that only the unconstrained seam will likely require the gussets although it is further contemplated that each end seam may employ one or more gussets in accordance with the present invention. For example, certain bags are employed as disposable bioreactors for placement in a rigid vessel such that one end seam will be fully constrained against expansion by, eg, the bottom of the rigid vessel while the opposed end will extend freely out of the top of the vessel with no constraining force acting on the apex of the seams as the bag interior is pressurized.

While the present invention contemplates that each gusset may be formed as a separate component to be attached to the bag, a gusset could be formed as an integral tab extending from a longitudinal edge of a sheet at a location adjacent where the apex will be formed. That is, the sheet forming a portion of the bag may be cut so that one edge includes a gusset tab extending from an edge such that the tab may be folded at the edge to be positioned adjacent a respective apex formed by the end seam. If formed on the longitudinal edge of a sheet which will be folded upon itself to form the apex (eg, a lateral sheet which partially forms the two oblique welds which define the apex), no slit will be required between the tab and the sheet from which it extends. If formed on the longitudinal edge of a sheet extending to one side of the apex (ie, a front or back sheet which forms a portion of the transversely-oriented seam) a slit is desirably cut along the longitudinal edge of the sheet to a location at or beyond the folding line of the tab when positioned to either side of the apex.

Figure 11:
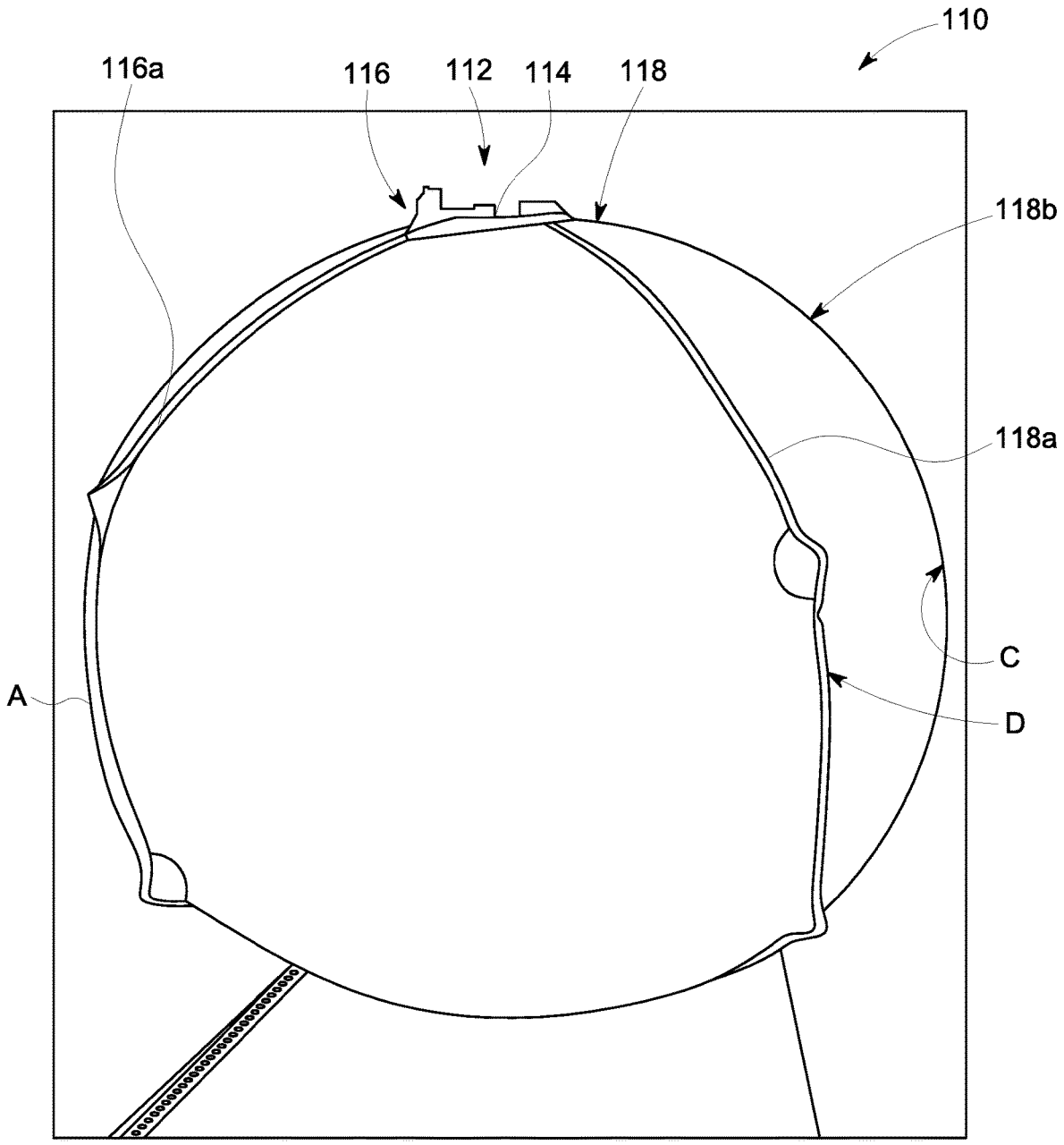
FIG. 11 depicts a bag of the present invention inflated while not constrained by a rigid vessel.
Figure 12:
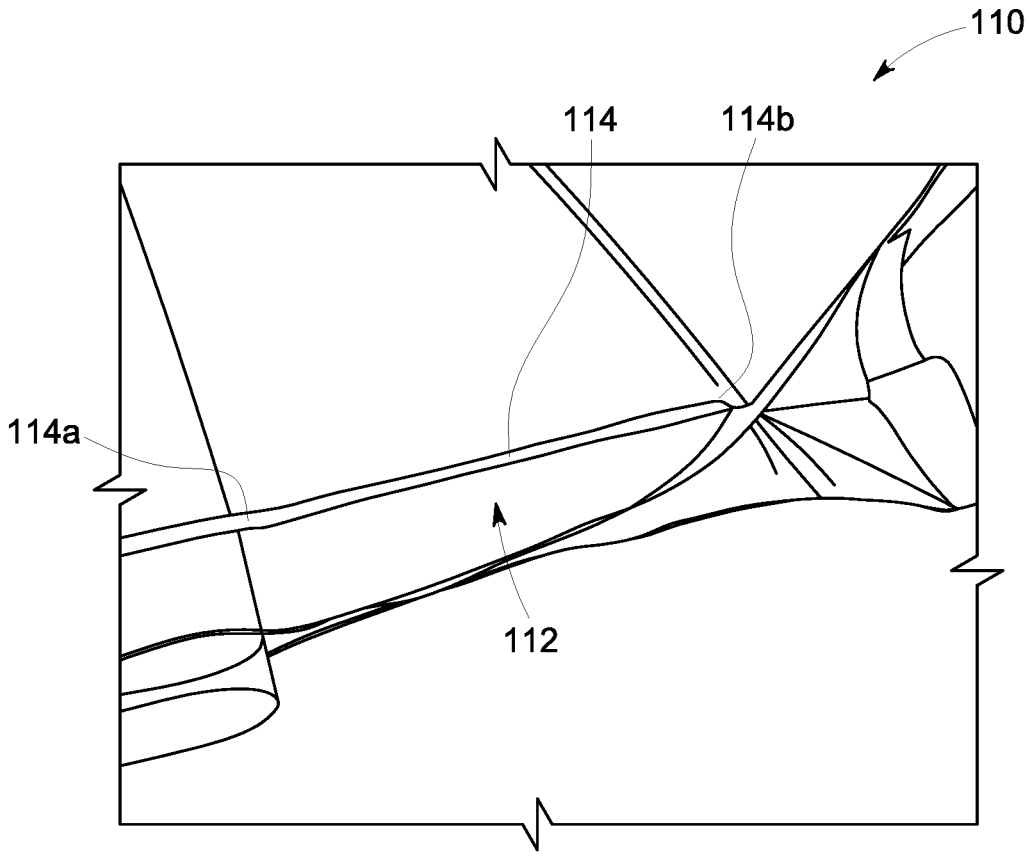
FIG. 12 depicts an end seam of the present invention having the two gussets welded into an extended transversely-oriented weld prior to forming the corresponding pairs of oblique welds.
Figure 13:
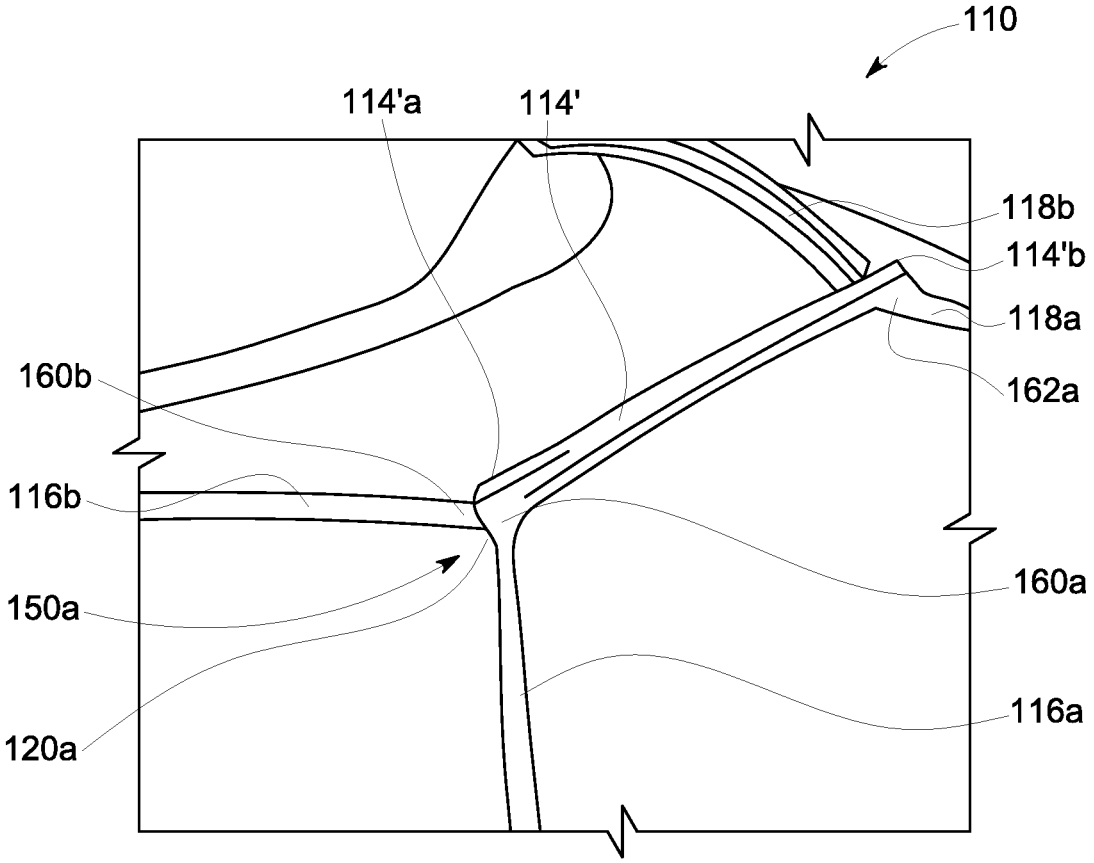
FIG. 13 depicts an end seam incorporating both a gusset and an extended transversely-oriented weld of the present invention.
Figure 14:
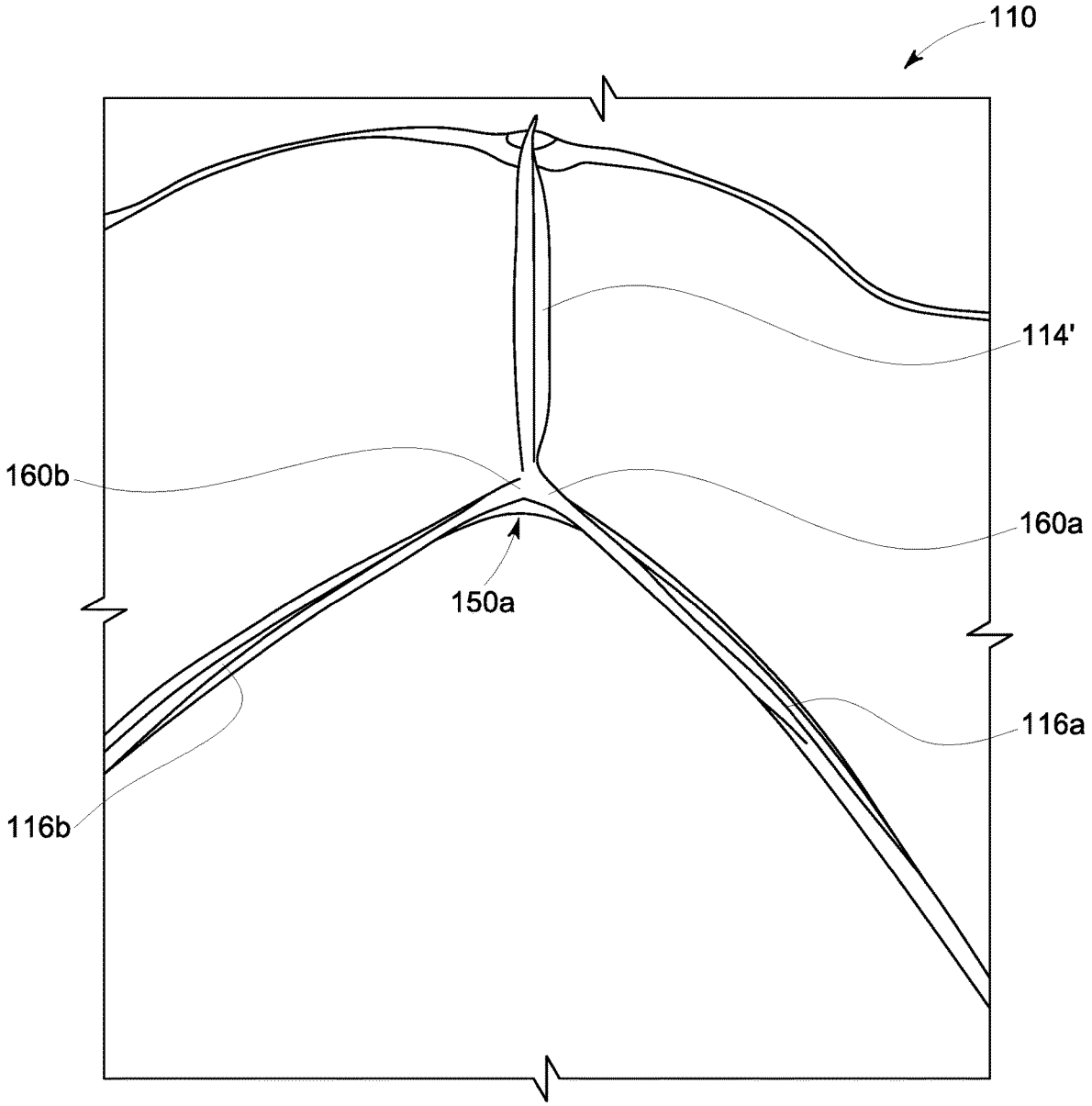
FIG. 14 depicts an alternate view of the seam of FIG. 8.
Figure 15:
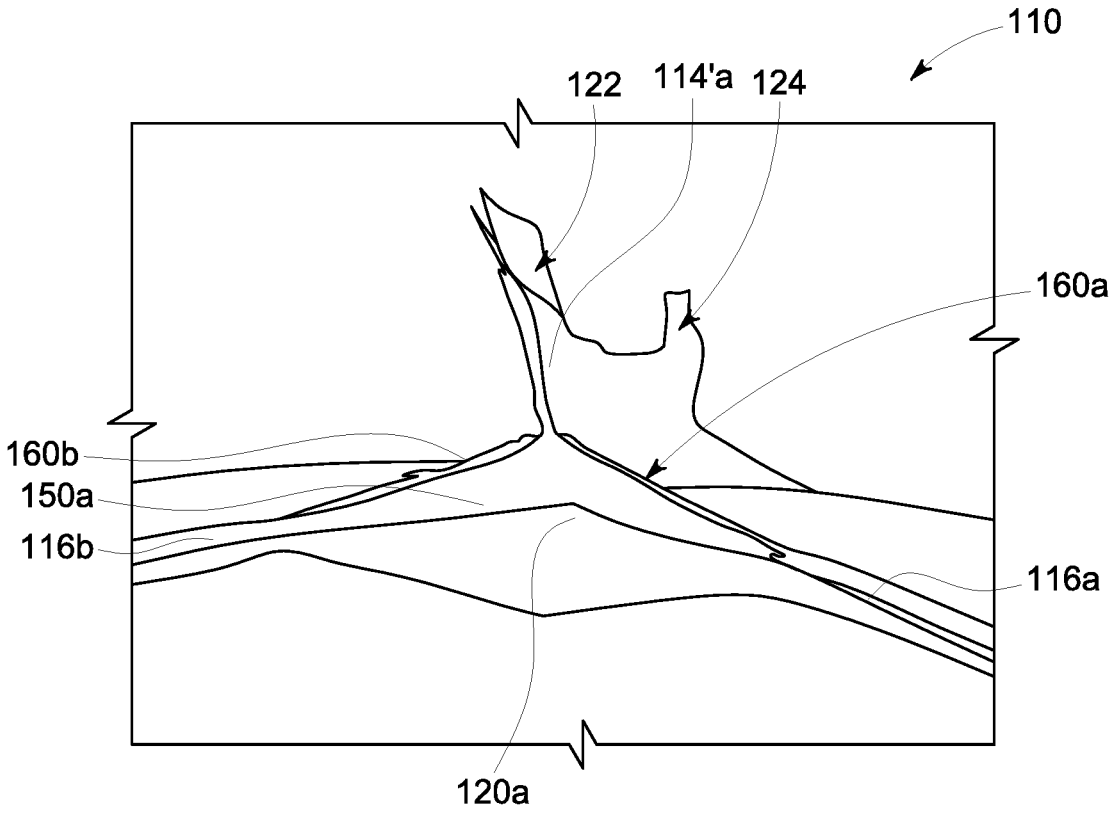
FIG. 15 depicts a view of a pocket formed by an extended transversely-oriented weld of the present invention.
Figure 16:
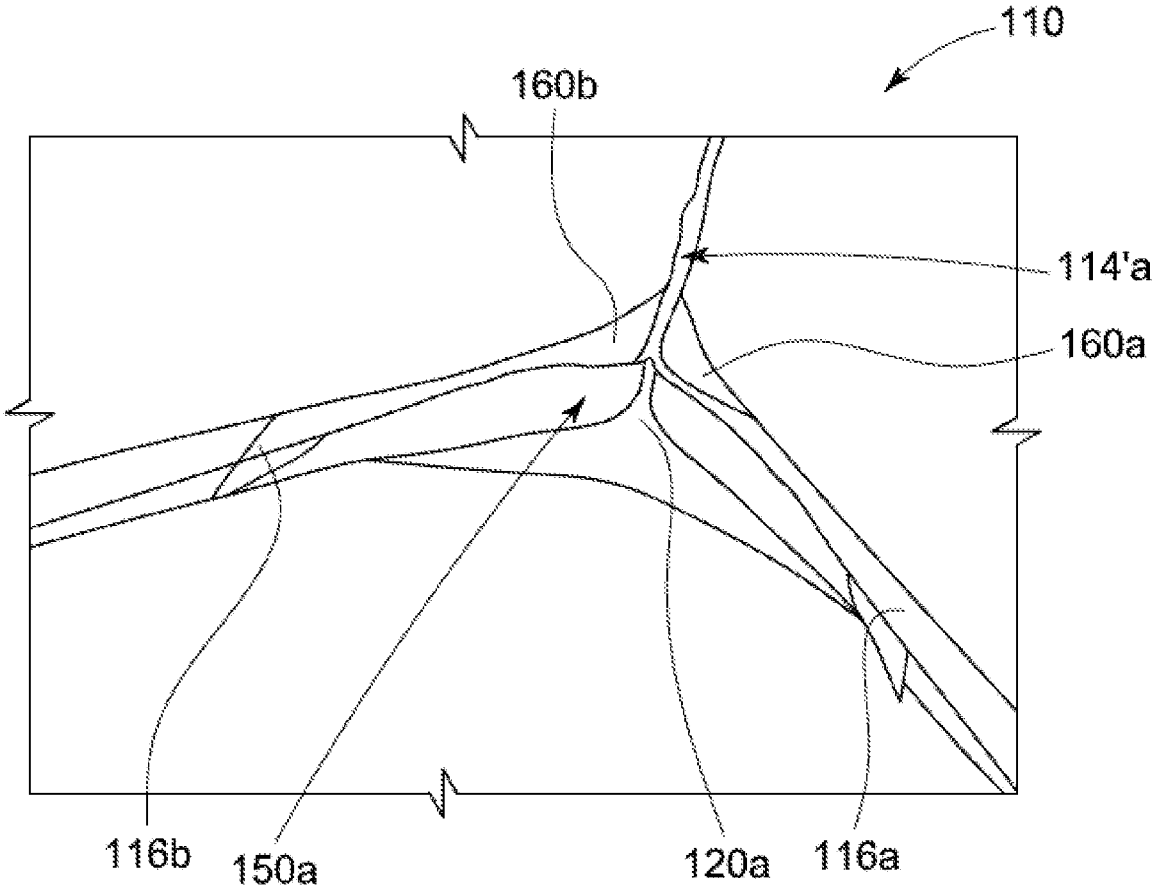
FIG. 16 depicts an alternate view of the pocket of FIG. 15.
Figure 17:
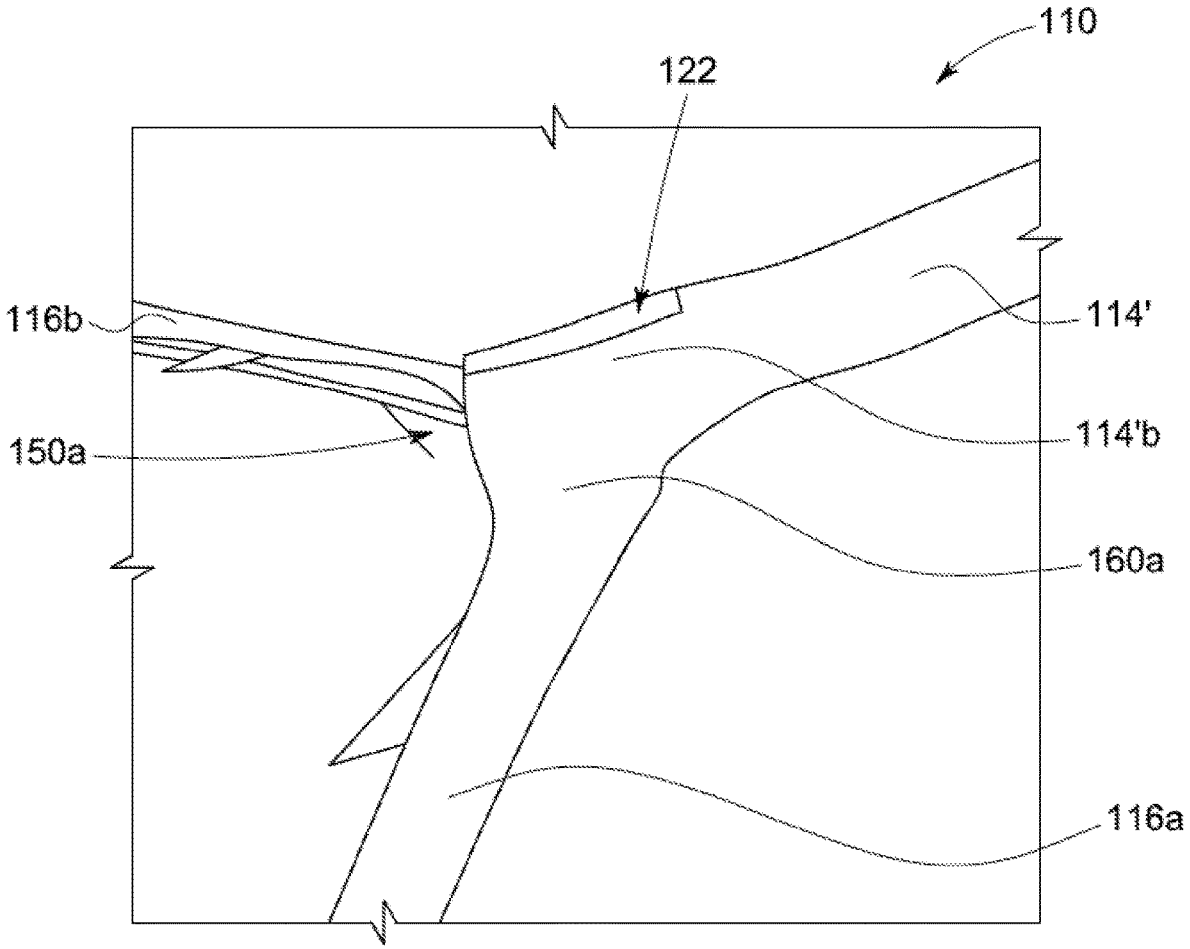
FIG. 17 depicts an alternate view of the pocket of FIG. 15.
Figure 18:
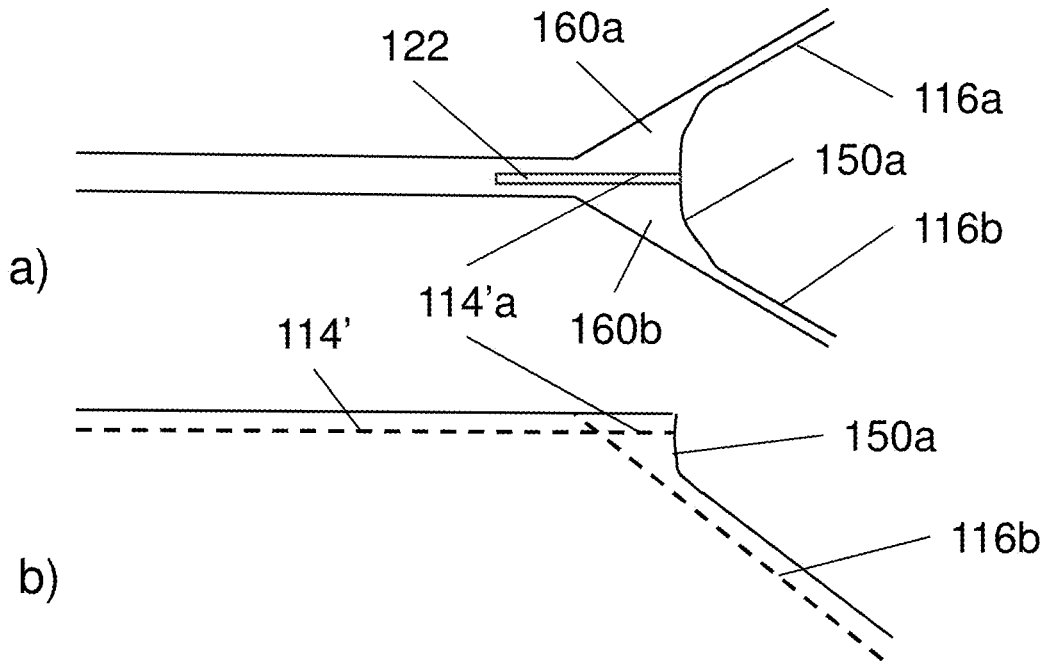
FIG. 18 depicts various views of details for an extended transversely-oriented weld of the present invention forming a pocket about an apex when formed from sheets of single layers.
Figure 19:
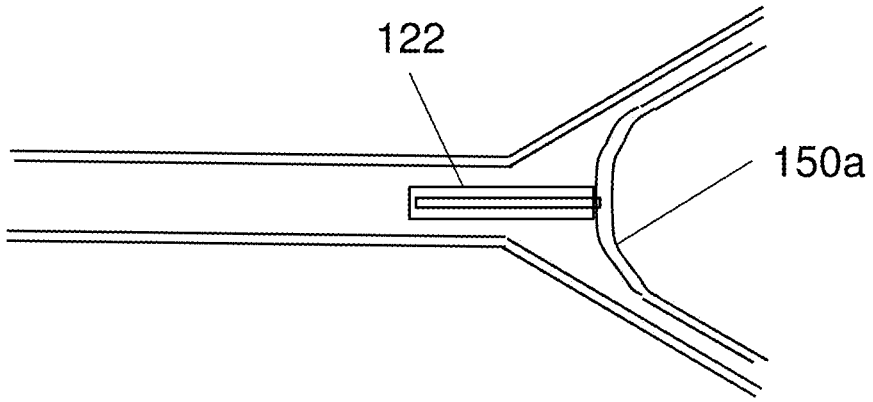
FIG. 19 depicts various views of details for an extended transversely-oriented weld of the present invention forming a pocket about an apex when formed from sheets of multiple layers.
Figure 20:
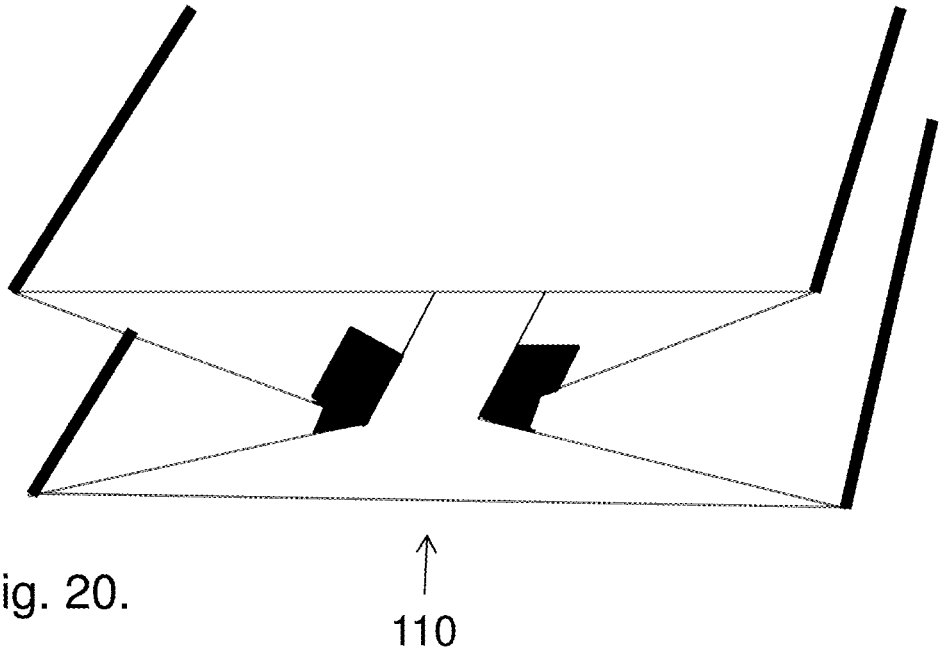
FIG. 20 depicts a bag formed from single-layer sheets prior to attaching gussets according to the present invention.
Figure 21:
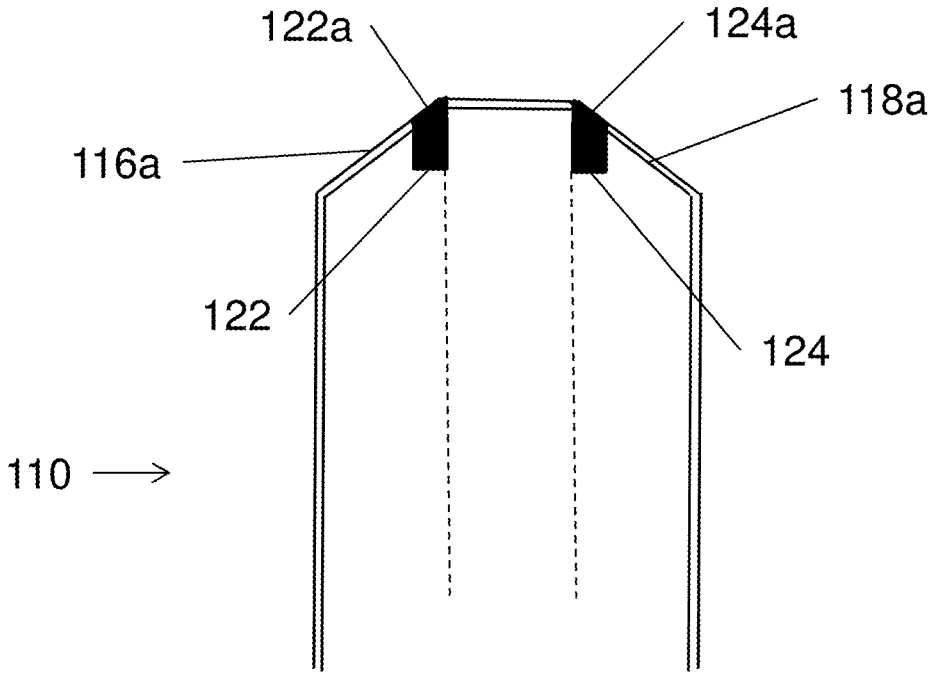
FIG. 21 depicts a front view of a bag formed from the single layer sheets as shown in FIG. 20 with a pair of gussets welded to the exterior surface of the bag at the respective oblique welds.
Figure 22:
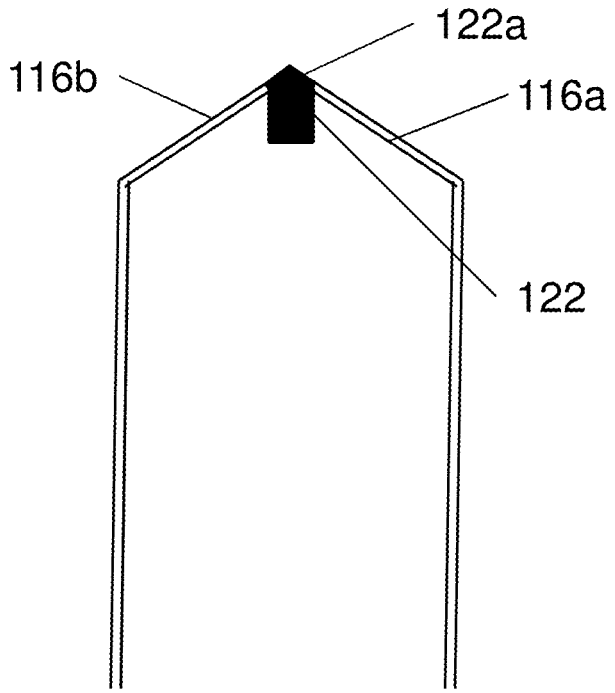
FIG. 22 depicts a side view of the bag of FIG. 21 and shows the positioning of a gusset with respect to its respective oblique welds and the apex formed thereby.
Figure 23:
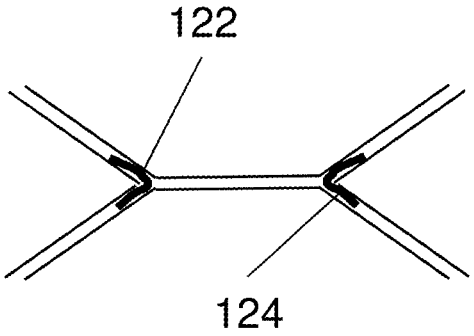
FIG. 23 depicts a top view of a bag of FIG. 21.

With reference to FIG. 11, a bag 110 of the present invention is shown inflated. Bag 110 is formed from four planar rectangular sheets having adjacent elongated longitudinal edges sealed together. The longitudinal ends of the bag are welded closed in a manner forming a complex seam 112 having a central transversely-oriented end weld 114 of the edges of opposed sheets bounded by a first pair 116 and a second pair 118 of oblique welds 116*a*, 116*b* and 118*a*, 118*b* where edges of adjacent sheets are welded together along an oblique angle extending from end weld 114 towards individual longitudinal edge welds of four planar rectangular sheets. By saying that weld 114 is 'bounded' by first pair 116 and second pair 118 of oblique welds, it is meant that each pair of oblique welds terminates at one end of weld 114, whether at an extreme transverse end thereof or at a location along the transverse end of weld 114 towards the rest of the bag. When laying flat, each longitudinal end of bag 110 appears as a transverse edge with tapering edges extending from the central weld towards the outer edges of the longitudinal edges. Front and back sheets are joined together along central transversely-oriented weld 114 while opposed side sheets are each only welded to the front and back sheets, but not to each other.

When bag 110 is formed from sheets having major surfaces formed solely or predominately of a weldable material, such as polyethylene, the edges of each major surface will be weldable to each other. When it is desired that the edges of such material not be welded together, an operator must take care to individually present the edges to be welded together between the opposing jaws of the welding device. Alternatively, multiple overlying seams may be positioned in overlying registry between the opposing jaws of the welding device while having a non-weldable material, such as PTFE, positioned between adjacent surfaces where no weld is desired. The non-weldable materials, such as PTFE, are deemed such as they may be formed of a material having a much higher melting point such that the welding device is unable to cause them to join to an adjacent, overlying surface in a welded seam.

When bag 110 is formed from sheets having one major surface formed solely or predominately of weldable material, such as polyethylene, and the other major surface formed from a non-weldable material, such as nylon, the welds may be selectively formed along edges of adjacent (or overlapping) weldable material, while no welds will be formed along adjacent edges of the non-weldable material.

Despite being formed from rectangular sheets, as shown, e.g. in FIG. 11, an unconstrained bag 110 may assume a spherical shape when inflated, assisted in part by the shape of the welds at each longitudinal end of the bag.

With additional reference to, e.g. FIGS. 8-9 and 13-15, each pair 116 and 118 of oblique welds are coterminal so as to form angle therebetween referred to herein as an apex 120*a* and 120*b*, respectively.

Referring to FIGS. 4-19, the present invention also provides an elongate plastic bag 110 having at least one longitudinal end weld 112. End weld 112 includes an elongate transversely-oriented weld 114 bounded at each end 114*a* and 114*b* by a first pair 116 and a second pair 118 of coterminous oblique welds 116*a*, 116*b* and 118*a*, 118*b*, respectively. Oblique welds 116*a*, 116*b* and 118*a*, 118*b* extend along an oblique angle from the first and second ends 114*a* and 114*b* of transversely-oriented weld 114, respectively, such that each pair of oblique welds 116*a*, 116*b* and 118*a*, 118*b* forms a first and second apex 120*a* and 120*b*, respectively, adjacent its respective end 114*a* and 114*b* of the transversely-oriented weld 14. Each apex 120*a* and 120*b* is formed by a single sheet that is bounded by oblique welds 116*a*, 116*b* and 118*a*, 118*b*, respectively.

The present invention provides a first and second planar gusset 122 and 124 attached to bag 110 along the first and second pair of oblique welds 116*a*, 116*b* and 118*a*, 118*b* so as to overlie the first and second apex 120*a* and 120*b*, respectively. Each gusset 122 and 124 includes a first edge 122*a* and 124*a*, respectively, adhered either to or within their respective oblique welds and a webbing portion 126 and 128, respectively, which are positioned to lie across (or to be adjacent to) their respective apex 120*a* and 120*b*. Each gusset is thus welded to a pair of oblique welds so that the apex is at least partially bounded by those oblique welds. The present invention contemplates that the webbing portions 126 and 128 may freely extend from their respective welds or may themselves be affixed to the sheet forming the respective apex 120*a* and 120*b*.

Figure 4A:
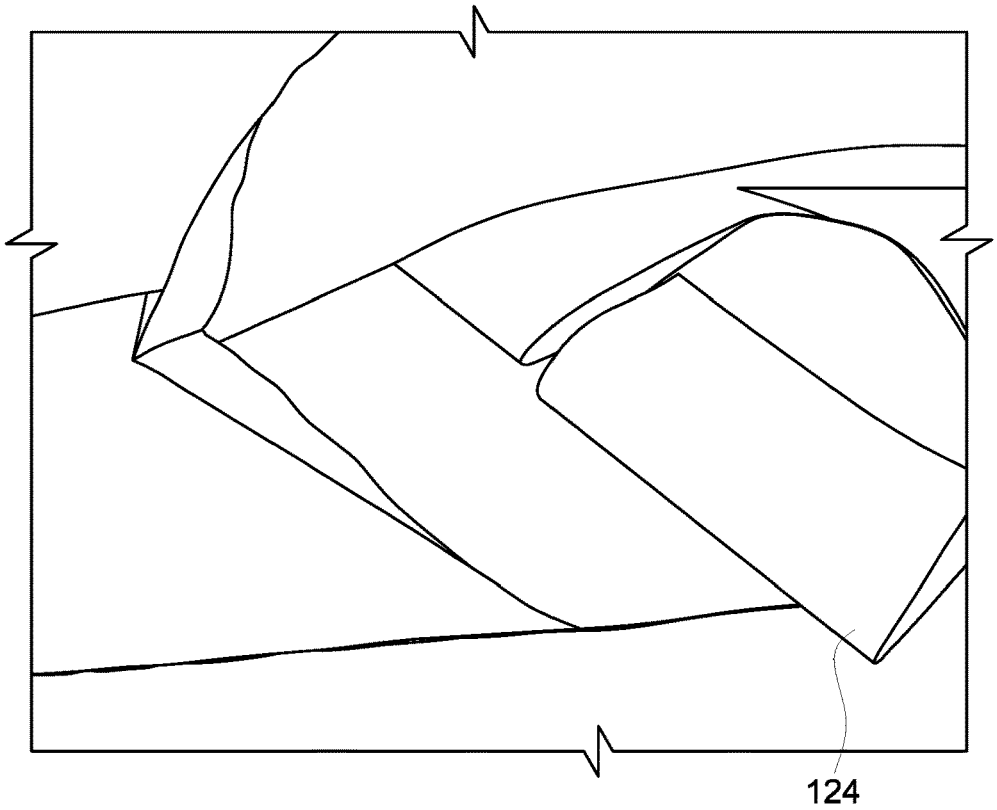
FIG. 4 depicts a gusset of the present invention being inserted between two layers of a sheet which is worked to be part of a pair of oblique welds which are coterminous adjacent an apex of the end seam. a) photograph, b) contour outline of photograph.
Figure 4B:
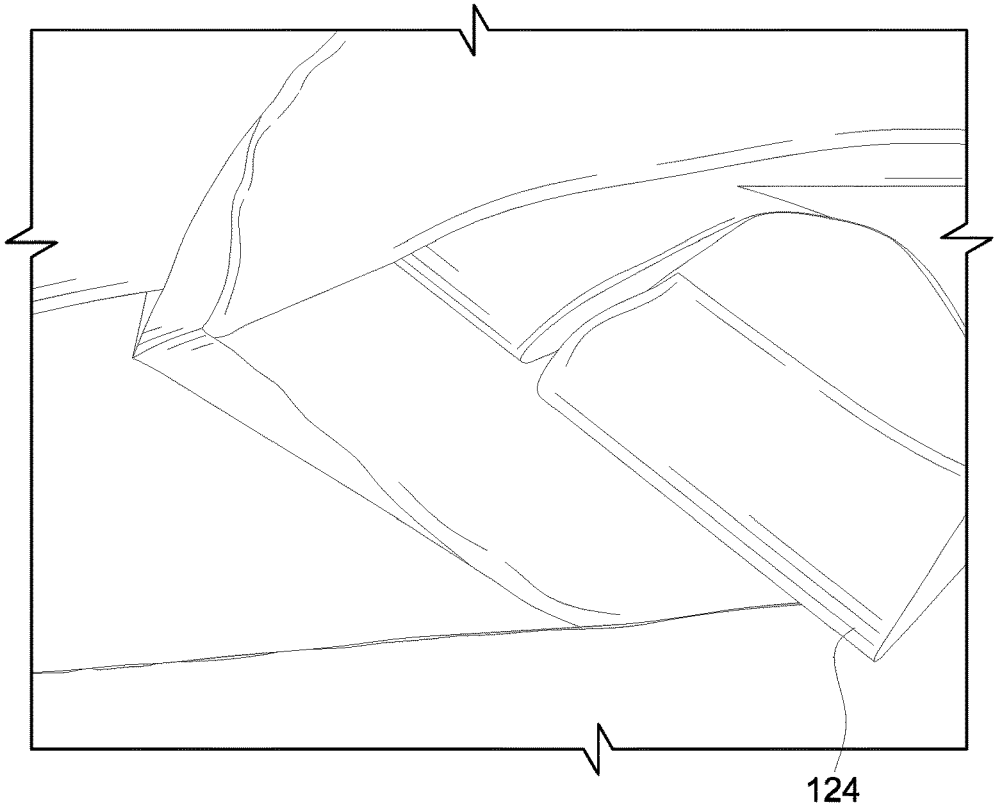
Figure 5:
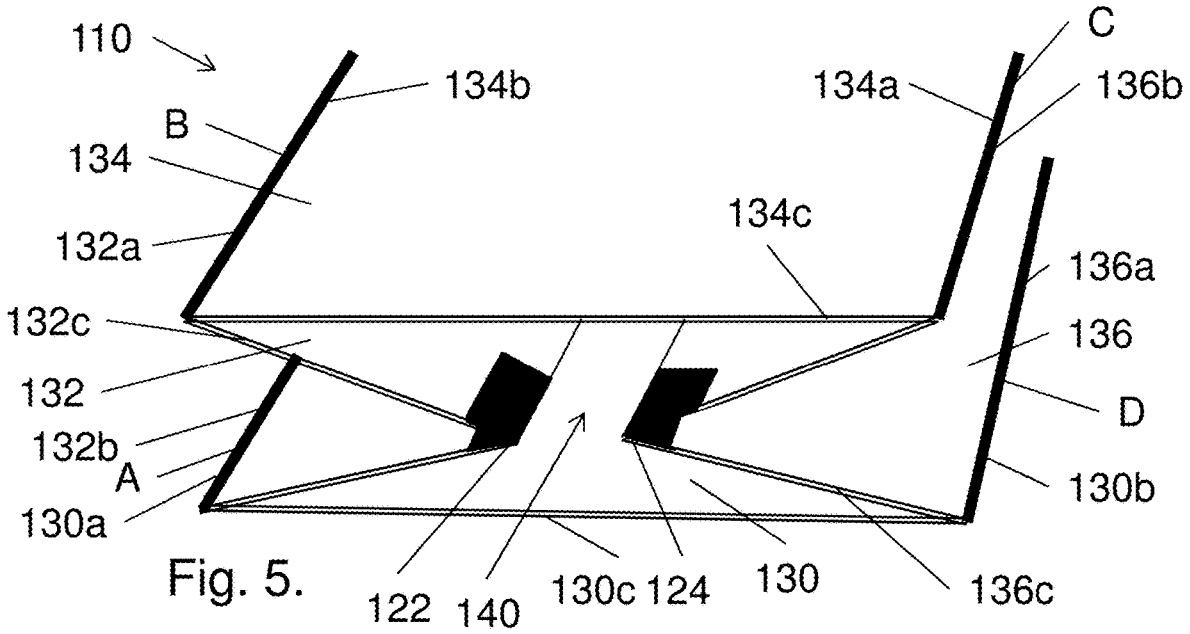
FIG. 5 depicts a pair of gussets each being inserted between two layers of a sheet forming a portion of a bag of the present invention.
Figure 10:
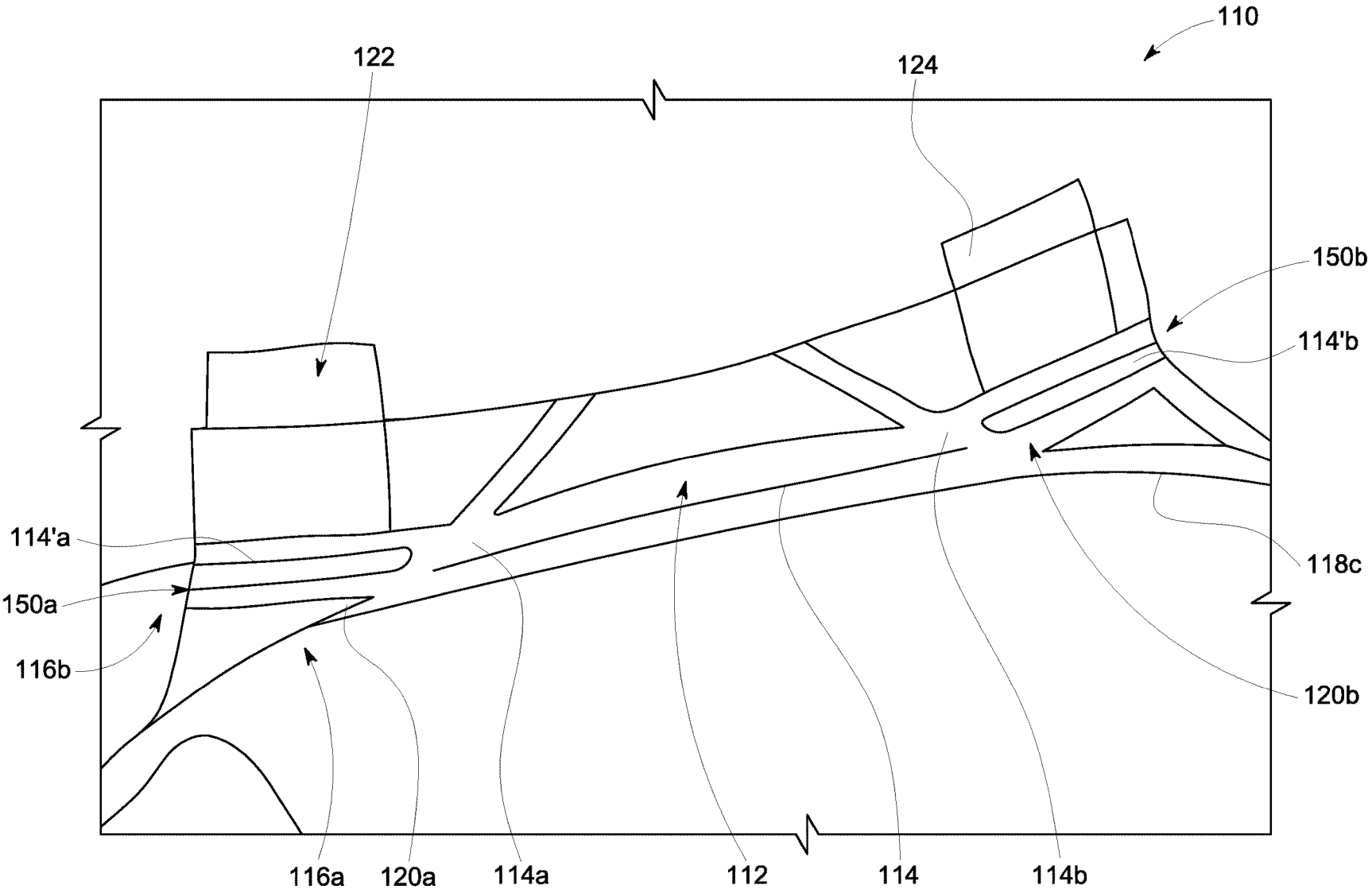
FIG. 10 depicts a seam of the present invention having two gussets welded therein as well as an extended transversely-oriented weld which extends beyond each apex.

The present invention further contemplates that each gusset may be positioned along any surface of a sheet forming an apex. If the sheet forming the apex is formed of a single layer having two opposed major surface, one surface facing the contents or interior of the bag and the other surface facing outwardly or on the outside of the bag, the gusset may be attached to its oblique seams on either the interior surface of the sheet forming the apex or the outside surface thereof. When the gusset is positioned along the interior surface of such a bag, the first edge thereof will be positioned between within the oblique weld, i.e. between the adjacent edges which are brought together to form the oblique edges. Additionally, if the sheet forming the apex is itself formed of multiple layers, the gusset may be similarly positioned along the interior surface of the sheet facing the interior of the bag, along the exterior surface of the sheet on the exterior surface of the bag, or between adjacent layers of the sheet (eg, as shown in FIGS. 4, 5, and 10), so long as a portion of the gusset is included in the oblique welds.

Any sheet edges which are brought together to form a welded seam are part of surfaces formed from a weldable material. Likewise, each major surface of the gusset is desirably formed from a weldable material so that the gusset may be heat welded to the two sheet edges which form the oblique welds. Desirably the gusset provides opposing surfaces formed of the same material used for the surface to which it is affixed, although any suitable material to be consistent with the teachings of the present invention may be employed.

Alternatively still, for certain applications, end seam 112 may be formed of edges which are adhered together using suitable adhesives. However, for many biological applications, such as a bioreactor or mixing unit, it will be preferable to heat weld these edges together so as to avoid introducing additional material which must be compatible with the contents to be provided into the interior of the bag. For other applications, however, adhesive bonding of the end seam and the gusset may be sufficient.

The present invention further contemplates that each gusset is positioned at one end of the transverse weld such that each gusset extends within one pair of the coterminous oblique welds at a location adjacent the apex. Desirably, each gusset extends partially along or within within one pair of coterminous oblique welds out to a location adjacent such that the apex is at least partially bounded by the oblique welds. More desirably, the gussets extend well beyond the apex region to provide a higher design margin before the bag experiences a material failure at the apex. By this, it is meant for example that the gusset edge 126 more desirably extends along each oblique weld 116*a* and 116*b* to a point along the oblique welds well beyond the apex so as to better prevent material failure at the apex 120*a*. The size of the gusset of the present invention and its extent along its respective oblique welds that it extends may be selected according to the configuration of the end seam, the size of the bag, and/or the particular application for the bag.

Figure 6:
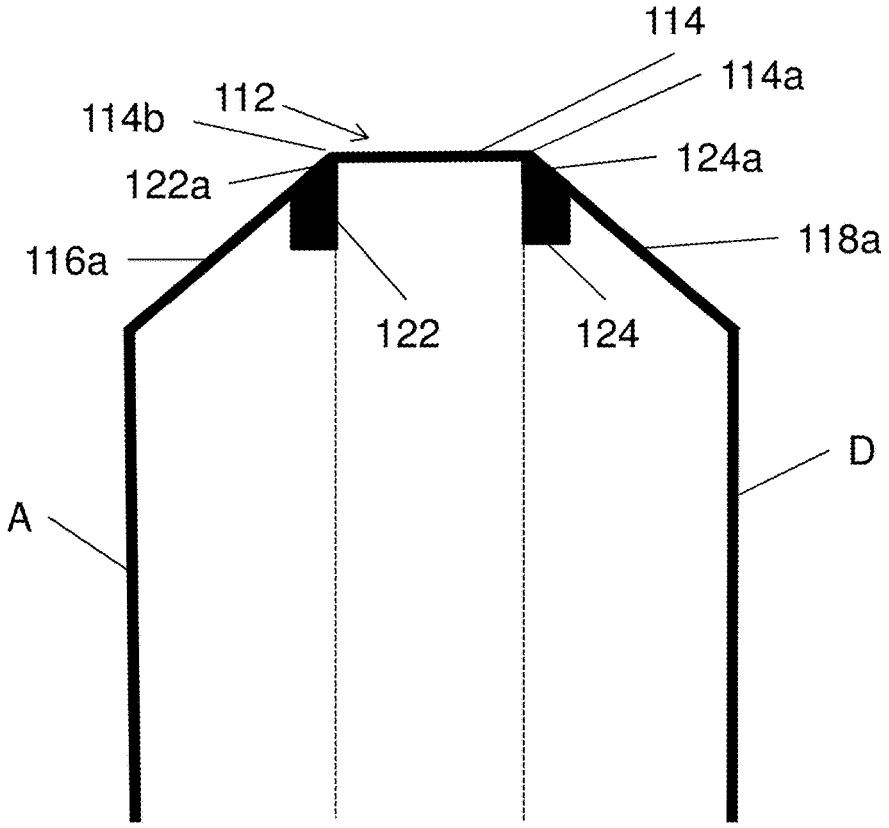
FIG. 6 depicts a side view of a bag of the present invention showing the positioning of a pair of gussets with respect to their respective oblique welds of the bag.
Figure 7:
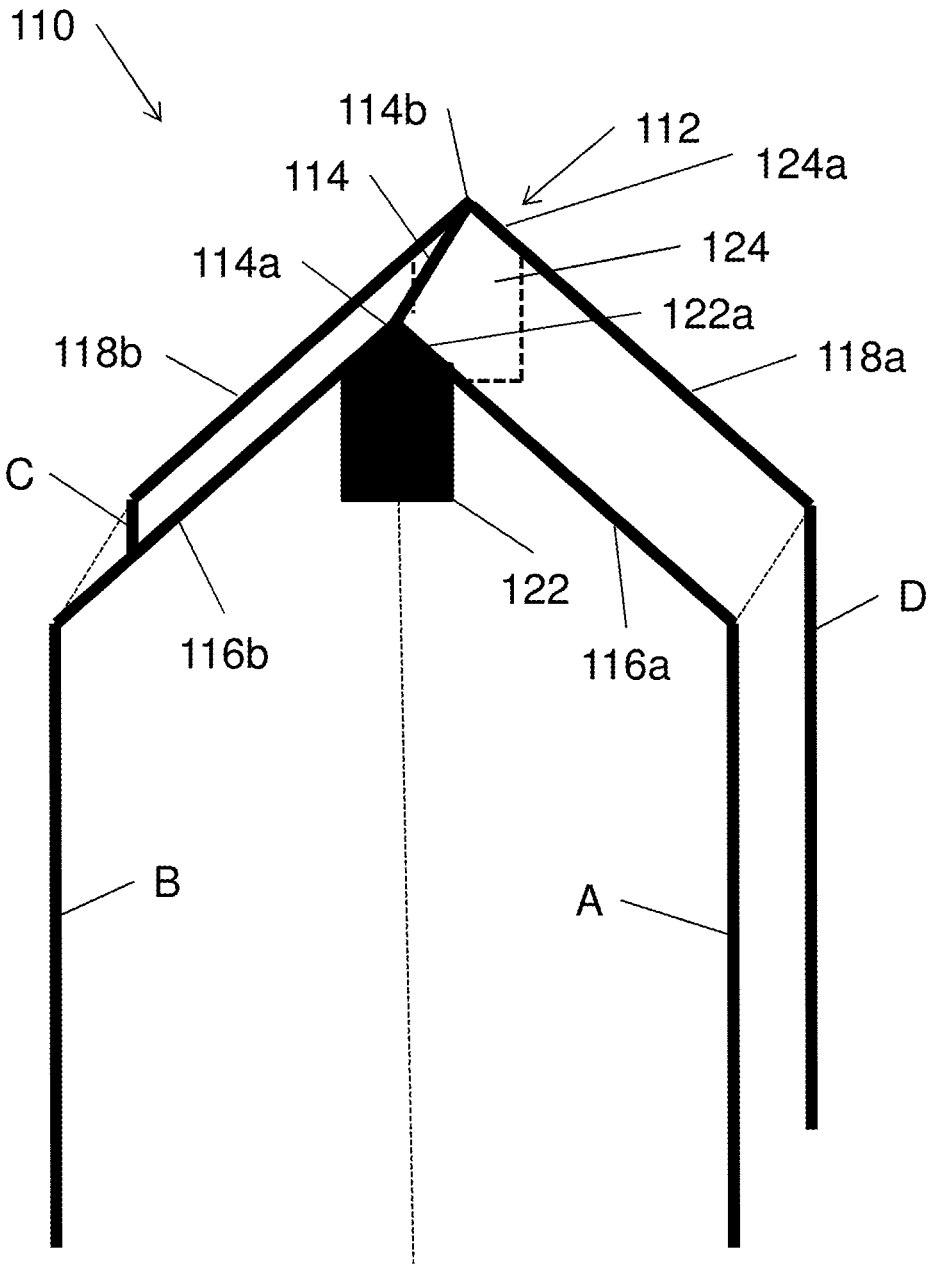
FIG. 7 depicts another side view of a bag of the present invention showing the positioning of a pair of gussets with respect to their respective oblique welds of the bag.
Figure 8:
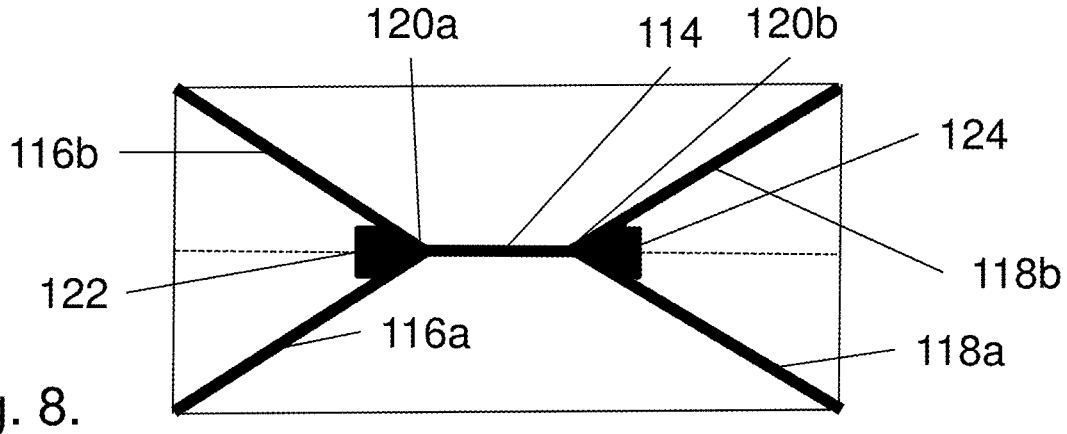
FIG. 8 depicts a top view of a bag of the present invention showing the positioning of a pair of gussets with respect to each adjacent apex.
Figure 9:
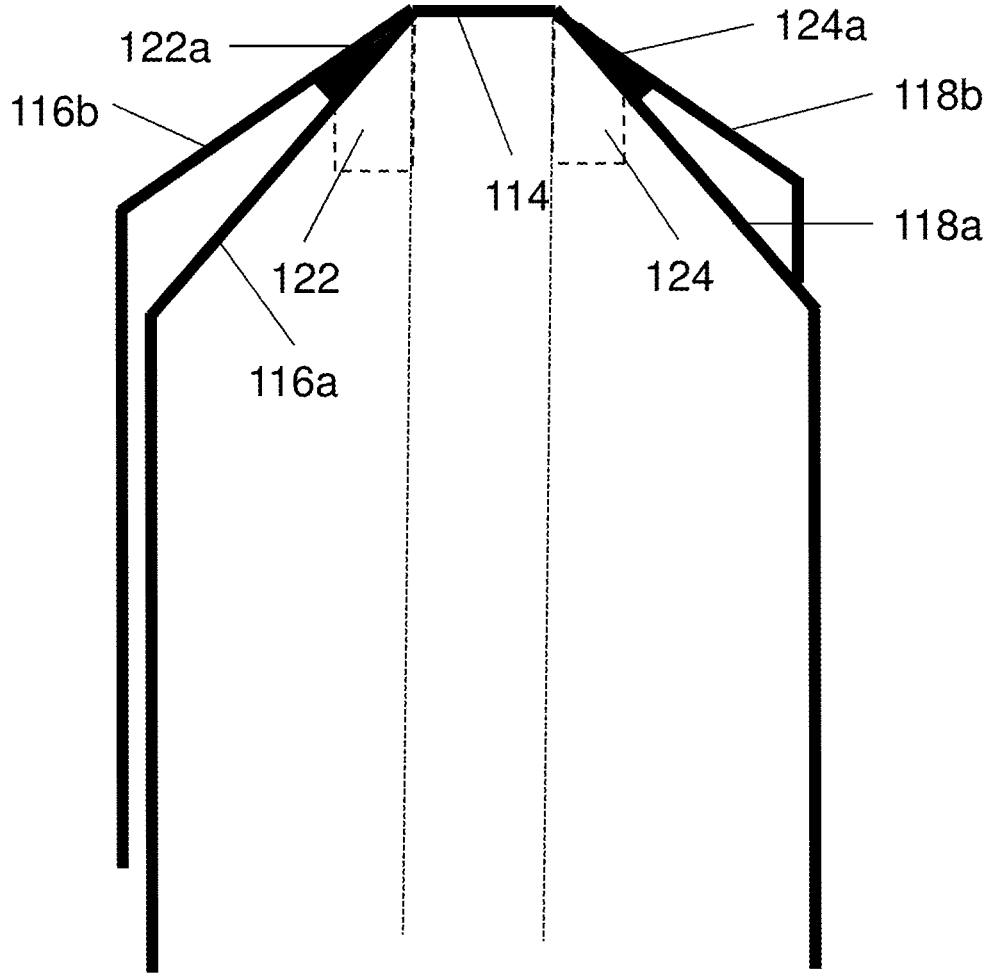
FIG. 9 depicts a top oblique view of a bag of the present invention showing each gusset extending along or within its respective oblique welds.

With particular reference to FIG. 5, bag 110 may be formed from four elongate rectangular sheets 130, 132, 134, and 136. Each of sheets 130, 132, 134, and 136 includes first and second transversely-opposed longitudinal edges 130*a* and 130*b*, 132*a* and 132*b*, 134*a* and 134*b*, and 136*a* and 136*b*, and first and second longitudinally-opposed transverse edges 130*c* and 130*d*, 132*c* and 132*d*, 134*c* and 134*d*, and 136*c* and 136*d*, respectively. Each sheet 130, 132, 134, and 136 is uniquely joined along its first longitudinal edge 130*a*, 132*a*, 134*a*, and 136*a* to the second longitudinal edge 130*b*, 132*b*, 134*b*, and 136*b* of one of the other sheets so as to form longitudinal seams A, B, C, and D. Each sheet is also and uniquely joined along its first transverse edge 130*c*, 132*c*, 134*c*, and 136*c* to the first transverse edge 130*c*, 132*c*, 134*c*, and 136*c* of one or two of the other sheets, as can be seen from the figure, so as to form an end seam 112 at a first longitudinal end of the bag (FIG. 6). Similarly, each sheet is also and uniquely joined along its second transverse edge 130*d*, 132*d*, 134*d*, and 136*d* to the second transverse edge 130*d*, 132*d*, 134*d*, and 136*d* of one or two of the other sheets, to form a second end seam 112 at the opposed end of bag 110 such that the four sheets may be expanded to form an elongate cylindrical shape and wherein the four sheets define an elongate container cavity 140 therebetween. Bag 110 is contemplated to accept various fitting attached thereto so as to provide ports for delivering and withdrawing materials into cavity 140, providing access for various probes and sensors, or a base for an impeller to be located in cavity 140, as is known in the art of mixers and bioreactors.

Figure 24:
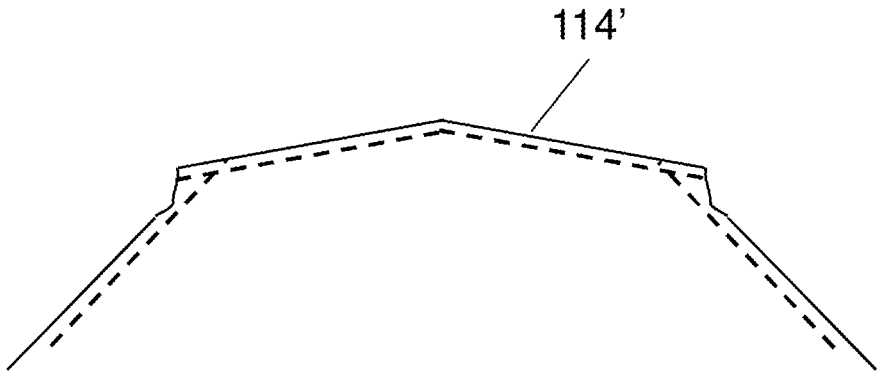
FIG. 24 depicts bag of the present invention having a transverse seam formed from a non-linear shape.

Referring still to FIGS. 5 and 6, transversely-oriented weld 114 is formed by joining opposed portions of the first transverse edges 132*c* and 134*c* of two of sheets 132 and 134. Sheets 132 and 134 extend in facing opposition to each other across the container cavity. While transversely-oriented weld 114 is shown to extend continuously between its endpoints 114*a* and 114*b* along a substantially linear line, the present invention contemplates that weld 114 may extend between endpoints 114*a* and 114*b* along other continuous lines, such as a substantially arcuate line, or multiple linear segments (as shown in FIG. 24).

With reference to FIGS. 5-9, each of the oblique welds 116*a*, 116*b*, 118*a*, and 118*b* is formed by edge portions of longitudinally-adjacent sheets welded together from a respective end of the transversely-oriented weld to the joined first and second longitudinal edges of the adjacent sheets. The angles formed by each pair 116 and 118 of oblique welds about apex 120*a* and 120*b*, respectively is desirably about the same and desirably is between about 80 degrees and 90 degrees, although the present invention contemplates angles outside of this range. The angles formed by each oblique weld with transversely-oriented weld 114 (or a segment extending between ends 114*a* and 114*b* when weld 114 does not follow a linear path) is desirably between 130 and 135 degrees; desirably about 135 degrees when the adjacent oblique welds form about an 90 degree angle and about 130 degrees when the adjacent oblique welds form about a 80 degree angle, although the present invention contemplates angles outside this range as well. Oblique welds 116*a* and 116*b* extend from end 114*a* of transversely oriented weld 114 to longitudinal edge welds A and B, respectively, while oblique welds 118*a* and 118*b* extend from end 114*b* of weld 114 to longitudinal edge welds D and C, respectively.

FIGS. 20-23 depict how a bag 110 may be formed from single layer sheets. In the embodiments of FIGS. 20-23, the gussets are welded along the respective oblique welds at a location on the exterior surface of the bag. The present invention also contemplates that the gussets may be welded to the interior of the oblique welds so as to be positioned adajacent the fluid-contacting surface of the sheets in the interior of the bag.

While bag 110 is shown formed from four rectangular sheets joined as just described, the present invention contemplates that seam 112 may be formed from other combinations and shaped sheets. For example, bag 110 may be alternatively formed from an elongate flexible plastic tube that may be folded in a manner similar to that shown for the rectangular sheets. Such a plastic tube is contemplated to be formed from a single sheet having a single longitudinal seam weld or even from an elongate extruded tube having no longitudinal seams but providing opposed cylindrical edges at each end which may be joined together according to the present invention.

As shown in FIGS. 10, 11, and 13-19, the present invention alternatively contemplates providing an extended transversely-oriented weld 114' which extends past each apex 120*a* and 120*b* on an end of bag 110 so as to further provide strength thereabout. In particular, the extended transversely-oriented weld 114' extends beyond the each apex 120*a* and 120*b* by a distance that is less than a radius of the bag 110, when expanded and unconstrained, minus a distance from a central axis of the bag 110 to the respective apex 120*a* and

120*b*. Weld 114' may e.g. extend at least 0.5 cm or at least 1 cm, such as 1-5 cm or 1-3 cm beyond each apex 120*a*, 120*b*. The present invention contemplates that extended weld 114' may be a stand-alone solution to the stress concentration failures at an apex provided without an inserted gusset as previously described or may be provided in addition to the gussets of the present invention. Additionally, the present invention contemplates that extended weld 114' may be provided as an extension from each end of weld 114 or may be provided as a second transversely-extending weld which runs parallel to weld 114 but beyond its ends 114*a* and 114*b*. Weld 114' includes opposed ends 114'*a* and 114'*b* which transversely past each apex 120*a* and 120*b* so as to define transversely-opening pockets 150*a* and 150*b*, respectively. Weld 114' is contemplated to provide additional support and stress relief for apex 120*a* and 120*b* to help prevent material failure thereat.

A webbing 160*a* and 160*b* spans between end 114'*a* and oblique welds 116*a* and 116*b*, respectively to further define pocket 150*a*. Similarly, webbing 162*a* and 162*b* spans between end 114'*b* and oblique welds 118*a* and 118*b*, respectively to further define pocket 150*b*. Each of webbings 160*a*, 160*b*, 162*a* and 162*b* are desirably formed from the same sheets of material which are joined to form oblique welds 116*a*, 116*b*, 118*a*, and 118*b*, respectively, although as described below, portions of the layer with the exterior surface about the apex may need to be cut away so as to allow weldable surfaces otherwise unexposed to be joined together to form each end 114'*a* and 114'*b* of weld 114'.

Opposed ends 114'*a* and 114'*b* of weld 114' may thus be formed by joining together a portion of the outer surface of outermost sheet extending between adjacent oblique welds. For bags in which the outer surface of these portions of the bag include weldable material, these folded-onto-itself sheet portions may be heat welded together to form each end 114'*a* and 114'*b*. For bags in which the outer surface of the bag is formed of a non-weldable material, such as nylon, the present invention contemplates cutting away the portion of the sheet with this non-weldable material so as to expose the weldable material from an interior surface of the bag—whether it comes from a layer of the same sheet or from a layer of an adjacent sheet—so that these weldable portions may be joined together. When cutting away a portion of the outer layer, it is more desirable that the trimmed-away portion is cut to form rounded corners so as to reduce stress-concentrations at sharp corners formed in the remaining material on the bag about any sharp corners. Alternatively, these portions of the exterior surface of the bag may be adhesively or even mechanically joined together.

Testing of a bag incorporating just one of the gussets of the present invention and the extended seam 114' of the present invention each were able to withstand 6.9 kPa (1 psi) internal pressure within the bag before leaking. Testing of a bag incorporating both the gussets of the present invention and the extended seam of the present invention were able to withstand about 13 kPa (1.9 psi) internal pressure.

While the particular embodiment of the present invention has been shown and described, it will be apparent to those skilled in the art that changes and modifications may be made without departing from the teachings of the invention. The matter set forth in the foregoing description and accompanying figures is offered by way of illustration only and not as a limitation. The actual scope of the invention is intended to be defined in the following claims when viewed in their proper perspective based on the prior art.

What is claimed is:

1. A plastic bag comprising:

at least four sheets of material welded to one another about respective longitudinal edges thereof;

at least one longitudinal end weld, wherein the at least one end weld comprises an elongate transversely-oriented weld bounded by a first pair and a second pair of coterminous oblique welds extending along an oblique angle from first and second terminal ends of the transversely-oriented weld, respectively, such that each of the first and second pair of oblique welds forms a first and second apex, respectively, adjacent its respective end of the transversely-oriented weld, a first and second planar gusset, the first planar gusset and the second planar gusset being discrete pieces of material, respectively, that are in addition to the at least four sheets of material, and which are attached to the bag along or within the first and second pair of oblique welds so as to overlie the first and second apex, respectively;

wherein the plastic bag has a longitudinal extent measured in a direction perpendicular to the transversely-oriented weld and defining a height of the plastic bag; and wherein the first and second planar gussets do not extend over the entire longitudinal extent of the plastic bag.

2. The plastic bag of claim 1, wherein each gusset is inserted at each end, respectively, of the transversely-oriented weld such that each gusset extends within one pair of the coterminous oblique welds at a location adjacent the apex.

3. The plastic bag of claim 2, wherein each gusset extends partially within one pair of coterminous oblique welds at a location adjacent the apex.

4. The plastic bag of claim 3, wherein the at least four sheets of material include four elongate rectangular sheets, each of the sheets includes first and second transversely-opposed longitudinal edges and first and second longitudinally-opposed transverse edges, wherein each sheet is uniquely joined along its first longitudinal edge to the second longitudinal edge of one of the other sheets and uniquely joined along its second longitudinal edge first longitudinal edge of another of the other sheets, such that the four sheets may be expanded to form an elongate cylindrical shape and wherein the four sheets define an elongate container cavity therebetween.

5. The plastic bag of claim 4, wherein the transversely-oriented weld is formed by joining opposed portions of the first transverse edges of two of the sheets extending in facing opposition to each other across the container cavity.

6. The plastic bag of claim 5, wherein each oblique weld is formed by portions of longitudinally-adjacent sheets welded together from a respective end of the transversely-oriented weld to the joined first and second longitudinal edges of the adjacent sheets.

7. The plastic bag of claim 6, wherein the transversely-oriented weld holds portions of opposed sheets together.

8. The plastic bag of claim 7, wherein the transversely-oriented weld joins a portion of a sheet defining each apex onto itself.

9. The plastic bag of claim 8, wherein the joining of portions of the sheet defining each apex onto itself is by a weld, an adhesive, or a mechanical means.

10. A plastic bag comprising:

at least four sheets of material welded to one another about respective longitudinal edges thereof;

an elongate transversely-oriented weld intersecting a first pair and a second pair of coterminous oblique welds extending along an oblique angle from the transversely-oriented weld, such that each of the first and second pair of oblique welds forms a first and second apex, respectively, adjacent its respective end of the transversely-oriented weld;

a first and second planar gusset, the first planar gusset and the second planar gusset being discrete pieces of material, respectively, that are in addition to the at least four sheets of material, and which are attached to the bag along or within the first and second pair of oblique welds so as to overlie the first and second apex, respectively; and wherein the first and second planar gusset each extend away from the first and second pair of oblique welds;

wherein the plastic bag forms an elongate cylindrical shape having at least one semi-spherical end when expanded and unconstrained;

wherein the elongate transversely-oriented weld extends beyond each apex to a point shy of a circumferential boundary of the plastic bag when expanded to the cylindrical shape, such that opposed terminal ends of the elongate transversely-oriented weld fall between each apex and the circumferential boundary;

wherein the elongate transversely-oriented weld is continuous throughout its entire extent;

wherein the plastic bag has a longitudinal extent measured in a direction perpendicular to the elongate transversely-oriented weld and defining a height of the plastic bag; and wherein the first and second planar gussets do not extend over the entire longitudinal extent of the plastic bag.

* * * * *